US007348718B2

(12) United States Patent
Sakai et al.

(10) Patent No.: US 7,348,718 B2
(45) Date of Patent: Mar. 25, 2008

(54) DISCHARGE ELECTRODE IMPLEMENTED BY A WIDE BANDGAP SEMICONDUCTOR AND A DISCHARGE LAMP USING THE SAME

(75) Inventors: Tadashi Sakai, Yokohama (JP); Tomio Ono, Yokohama (JP); Naoshi Sakuma, Yokohama (JP); Mariko Suzuki, Yokohama (JP); Hiroaki Yoshida, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 286 days.

(21) Appl. No.: 10/899,153

(22) Filed: Jul. 27, 2004

(65) Prior Publication Data

US 2005/0062392 A1 Mar. 24, 2005

(30) Foreign Application Priority Data

Jul. 28, 2003 (JP) ..... P2003-202518

(51) Int. Cl.
*H01J 1/13* (2006.01)
*H01J 1/14* (2006.01)

(52) U.S. Cl. ..... 313/310; 313/311; 313/337; 313/346 R

(58) Field of Classification Search ..... 313/311
See application file for complete search history.

(56) References Cited

U.S. PATENT DOCUMENTS

| | | | | |
|---|---|---|---|---|
| 5,298,106 | A * | 3/1994 | Kabacoff et al. | 257/E21.043 |
| 5,670,788 | A * | 9/1997 | Geis | 257/10 |
| 5,880,559 | A * | 3/1999 | Fox et al. | 313/631 |
| 2001/0024084 | A1* | 9/2001 | Kajiwara | 313/486 |
| 2002/0057046 | A1* | 5/2002 | Yamamoto et al. | 313/311 |
| 2002/0140352 | A1 | 10/2002 | Sakai et al. | |
| 2004/0061429 | A1 | 4/2004 | Sakai et al. | |

FOREIGN PATENT DOCUMENTS

| | | |
|---|---|---|
| JP | 10-069868 | 3/1998 |
| JP | 2000-106130 | 4/2000 |

* cited by examiner

*Primary Examiner*—Mariceli Santiago
(74) *Attorney, Agent, or Firm*—Finnegan, Henderson, Farabow, Garrett & Dunner, L.L.P.

(57) ABSTRACT

A discharge electrode emitting electrons into a discharge gas, encompasses an emitter and current supply terminals configured to supply electric current to the emitter. The emitter embraces a wide bandgap semiconductor having at 300 K a bandgap of 2.2 eV or wider. Acceptor impurity atoms and donor impurity atoms being doped in the wide bandgap semiconductor, the activation energy of the donor impurity atoms being larger than the activation energy of the acceptor impurity atoms.

22 Claims, 10 Drawing Sheets

DISCHARGE ELECTRODE IMPLEMENTED BY A WIDE BANDGAP SEMICONDUCTOR AND A DISCHARGE LAMP USING THE SAME

CROSS REFERENCE TO RELATED APPLICATIONS

This application claims benefit of priority under 35 USC 119 based on Japanese Patent Application No. P2003-202518 filed Jul. 28, 2003, the entire contents of which are incorporated by reference herein.

BACKGROUND OF THE INVENTION

1. Field of the Invention

The present invention relates to a discharge electrode, a discharge lamp using the discharge electrode and a method for manufacturing the discharge electrode, and more particularly to a discharge electrode serving as a hot cathode, a discharge lamp using the discharge electrode and a method for manufacturing the discharge electrode.

2. Description of the Related Art

A hot cathode (discharge electrode), used for discharge lamps such as fluorescent lamps, emit electrons from its surface in an atmosphere of a discharge gas by being thermally heated under application of negative potential to its surface. The hot cathode widely utilizes a filament implemented by a thin refractory metal wire, formed into a coil configuration, which is heated by electric energy. Furthermore, thermionic emission is generally promoted as the work function of cathode material thereof is decreased, and thus a variety of metals or materials called emitter materials such as a barium (Ba)-based materials have been formed on the surface of the filament, by a coating method, an impregnation method, or the like, in order to reduce the work function of the filament material surface.

For example, in a fluorescent lamp, which is the most widely and generally used discharge lamp, the flow of electric current in the hot cathode involves the dissipation of energy, heating the whole system of the hot cathode, and the thermionic emission is initiated from the surface of the hot cathode. In earlier technology, the hot cathode was fabricated by coating tungsten filament with a barium-based emitter material. Earlier hot cathodes, or earlier discharge electrodes make it possible to emit electrons via a small drop of the cathode voltage, which supports the high luminous efficiency of earlier fluorescent lamps, whereas earlier fluorescent lamps are associated with the problem of short operation life. Moreover, to satisfy the requirements for high integration of devices and needs for miniaturization, the development of a high-performance hot cathode operating at an even lower temperature and with lower heat dissipation is required to meet the requirements thereof.

Recently, in Japanese Patent Application laid-open No. H10-698688 (hereinafter called "the first document"), a discharge lamp installing a specific hot cathode (discharge electrode) has been proposed, the specific hot cathode has a layer of particulate diamonds on the surface of the hot cathode material. Namely, particulate diamonds having an average particle diameter of 0.2 μm or less are coated on the surface of the hot cathode material in the first document.

Further, in Japanese Patent Application laid-open No. 2000-106130 (hereinafter called "The second document"), another discharge electrode for integrating into a low-pressure discharge lamp has been proposed. In the second document, fine diamond particles having a particle diameter of from 0.01 μm to 10 μm, preferably from 0.1 μm to 1 μm, are deposited on or impregnated into the surface of a tungsten coil. The diamond-deposited or -impregnated tungsten coil was integrated into the low-pressure discharge lamp as the discharge electrode. The objective of the second document was to suppress the deterioration of thermionic emission characteristics of the discharge electrode and to achieve long operation life of the low-pressure discharge lamp.

The techniques disclosed in the first and second documents, however, are not sufficient in efficient improvement because the applied power is mostly dissipated at the tungsten coil.

SUMMARY OF THE INVENTION

In view of these situations, it is an object of the present invention to provide a long life discharge electrode which allows adequate electrical conductivity from startup at room temperature and which enables efficient heating and thermionic emission, and to provide a discharge lamp using the discharge electrode, and further to provide a method for manufacturing the discharge electrode.

An aspect of the present invention inheres in a discharge electrode emitting electrons into a discharge gas, encompassing (a) an emitter encompassing a wide bandgap semiconductor having at 300 K a bandgap of 2.2 eV or wider, acceptor impurity atoms and donor impurity atoms being doped in the wide bandgap semiconductor, an activation energy of the donor impurity atoms being larger than the activation energy of the acceptor impurity atoms, and (b) current supply terminals configured to supply electric current to the emitter.

Another aspect of the present invention inheres in a discharge lamp encompassing (a) a discharge envelope in which a discharge gas is sealed, and (b) a discharge electrode disposed in the discharge envelope. Here, the discharge electrode embraces an emitter encompassing a wide bandgap semiconductor having at 300 K a bandgap of 2.2 eV or wider, acceptor impurity atoms and donor impurity atoms being doped in the wide bandgap semiconductor, an activation energy of the donor impurity atoms being larger than the activation energy of the acceptor impurity atoms; and current supply terminals configured to supply electric current to the emitter.

Still another aspect of the present invention inheres in a method for manufacturing a discharge electrode encompassing (a) depositing a wide bandgap semiconductor layer on a substrate to form a composite structure, the wide bandgap semiconductor layer having at 300 K a bandgap of 2.2 eV or wider; (b) doping simultaneously acceptor impurity atoms and donor impurity atoms in the wide bandgap semiconductor layer, an activation energy of the donor impurity atoms being larger than the activation energy of the acceptor impurity atoms; and (c) electrically connecting current supply terminals to the wide bandgap semiconductor layer, the current supply terminals being configured to supply electric current to the wide bandgap semiconductor layer.

Other and further objects and features of the present invention will become obvious upon an understanding of the illustrative embodiments about to be described in connection with the accompanying drawings or will be indicated in the appended claims, and various advantages not referred to herein will occur to one skilled in the art upon employing of the present invention in practice.

BRIEF DESCRIPTION OF THE DRAWINGS

Various embodiments of the present invention will be described with reference to the accompanying drawings. It is to be noted that the same or similar reference numerals are applied to the same or similar parts and elements throughout the drawings, and the description of the same or similar parts and elements will be omitted or simplified.

Generally and as it is conventional in the representation of electron devices, it will be appreciated that the various drawings are not drawn to scale from one figure to another nor inside a given figure, and in particular that the layer thicknesses are arbitrarily drawn for facilitating the reading of the drawings.

DETAILED DESCRIPTION OF THE EMBODIMENTS

In the following description specific details are set forth, such as specific materials, process and equipment in order to provide a thorough understanding of the present invention. It will be apparent, however, to one skilled in the art that the present invention may be practiced without these specific details. In other instances, well-known manufacturing materials, process and equipment are not set forth in detail in order not to unnecessary obscure the present invention. The technical principles of this invention can be altered in various manners within the scope of claims.

Prepositions, such as "on", "under" and "beneath" are defined with respect to a planar surface of the supporting member, regardless of the orientation in which the supporting member is actually held. A layer is on another layer even if there are intervening layers.

First Embodiment

Figure 1:
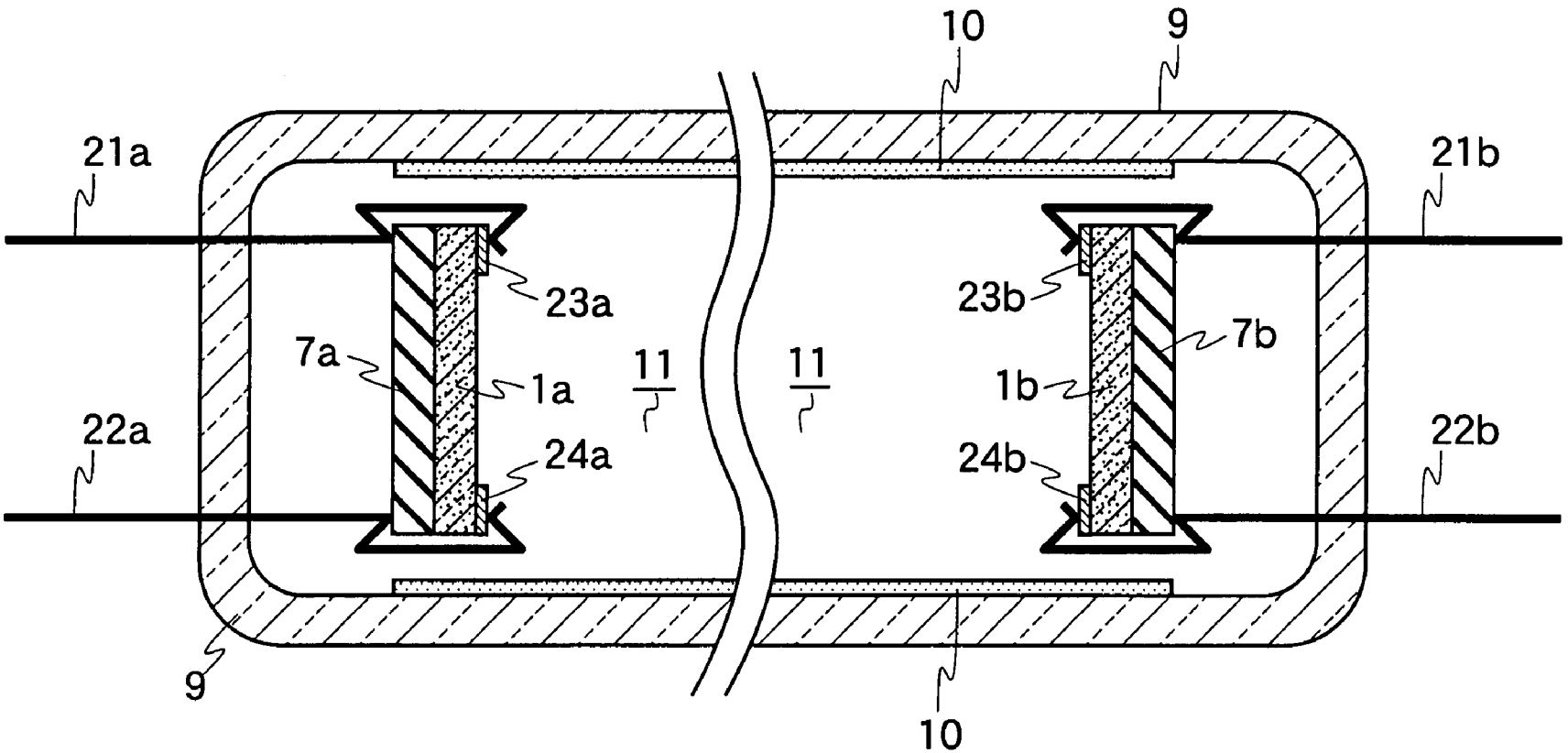
FIG. 1 is a schematic cross sectional view showing an overview of a discharge lamp relating to a first embodiment of the present invention.

A discharge lamp pertaining to a first embodiment of the present invention, as indicated in FIG. 1, encompasses a discharge envelope 9 in which a discharge gas 11 is sealed, a fluorescent layer 10 with a thickness of 50 μm to 300 μm formed on a portion of the inner wall of the discharge envelope 9, and a pair of discharge electrodes placed at both the ends of the discharge envelope 9 therein The discharge envelope 9 can utilize, for example, a glass tube composed of soda lime glass and borosilicate glass and the like.

Of the pair of discharge electrodes, the discharge electrode of the left side in FIG. 1 encompasses an insulating substrate 7*a* serving as a supporting member, and a wide bandgap semiconductor layer 1*a*, which serves as an emitter formed on the insulating substrate 7*a*. On the top surface of the wide bandgap semiconductor layer (emitter) 1*a* conductive films (contact films) 23*a*, 24*a* that implement a low-contact-resistance ohmic contact to the wide bandgap semiconductor layer 1*a* are selectively disposed. In regions close to the top surface of the wide bandgap semiconductor layer 1*a* directly beneath the conductive films (contact films) 23*a*, 24*a*, amorphous layers (amorphous contact regions) are formed respectively. Stem leads 21*a*, 22*a* are electrically connected to the wide bandgap semiconductor layer 1*a* via the conductive films (contact films) 23*a*, 24*a* The upper portion of each of the stem leads 21*a*, 22*a*, or the tip portion and the vicinity of the tip portion of each of the stem leads 21*a*, 22*a* is made of a material such as tungsten (W) or molybdenum (Mo), and the vicinity of the tip portion has a plurality of bent portions with acute angles (or almost right angles) to form a spring structure. However, the middle portion of each of the stem leads 21*a*, 22*a*, or the sealing portion between the stem leads and the discharge envelope 9 is implemented by nickel-cobalt-iron (Ni—Co—Fe) alloy such as "Kovar alloy". The stem leads 21*a*, 22*a* each are contacted at angular portions of bent portions thereof with the bottom surface of the insulating substrate 7*a* opposing to the conductive films (contact films) 23*a*, 24*a*, and pinch and hold a composite structure, or a laminated structure made of the insulating substrate 7*a* and the wide bandgap semiconductor layer 1*a*, from both the sides by elastic force. The stem leads 21*a*, 22*a* function as one pair of current supply terminals for supplying electric current to the emitter embracing the wide bandgap semiconductor layer 1*a*.

Similarly, the other of the pair of discharge electrodes, i.e., the right-hand discharge electrode of FIG. 1, also encompasses an insulating substrate 7*b* and a wide bandgap semiconductor layer 1*b* serving as another emitter formed on the insulating substrate 7*b*. On the top surface of the wide bandgap semiconductor layer (emitter) 1*b* are selectively made up conductive films (contact films) 23*b*, 24*b* which make ohmic contact to the wide bandgap semiconductor layer 1*b*. In regions close to the top surface of the wide bandgap semiconductor layer 1*b* directly beneath the conductive films (contact films) 23*b*, 24*b*, amorphous layers (amorphous contact regions) are formed respectively. Stem leads 21*b*, 22*b* are electrically connected to the wide bandgap semiconductor layer 1*b* via the conductive films (contact films) 23*b*, 24*b*. Stem leads 21*b*, 22*b* are electrically connected to the wide bandgap semiconductor layer 1*b* via the conductive films (contact films) 23*b*, 24*b*. The stem leads 21*b*, 22*b* each are contacted at angular portions of bent portions thereof with the bottom surface of the insulating substrate 7*b* opposing to the conductive films (contact films) 23*b*, 24*b*, and pinches and holds a laminated structure made of the insulating substrate 7*b* and the wide bandgap semiconductor layer 1*b* from both the sides by elastic force. The stem leads 21*b*, 22*b* function as one pair of current supply terminals for supplying electric current to the emitter embracing the wide bandgap semiconductor layer 1*b*. The pair of discharge electrodes can make use of various geometries such as a rectangle shape, a plate shape, a rod shape, and a wire shape, and is not particularly limited.

The conductive films (contact films) 23*a*, 24*a*; 23*b*, 24*b* can use nickel (Ni) film, tungsten (W) film, titanium (Ti) film, chromium (Cr) film, tantalum (Ta) film molybdenum (Mo) film, gold (Au) film, and the like. Or, an alloy film, a compound film, a multi-layer film (composite film) and the like, composed of a combination of a plurality of metals thereof, can be employed. For example, a multi-layer film such as titanium-platinum-gold (Ti/Pt/Au) film, titanium-nickel-gold (Ti/Ni/Au) film, or titanium-nickel-platinum-gold (Ti/Ni/Pt/Au) film, or the like can be selected.

Moreover, in an application field in which the contact resistance between the stem leads 21*a*, 22*a* and the wide bandgap semiconductor layer 1*a* or between the stem leads 21*b*, 22*b* and the wide bandgap semiconductor layer 1*b* is allowed to be high, as it is appropriate, the conductive films (contact films) 23*a*, 24*a*; 23*b*, 24*b*, and/or the amorphous layers (amorphous contact regions) directly beneath the conductive films (contact films) may be omitted The wide bandgap semiconductor layers 1*a*, 1*b* are doped with both acceptor impurity atoms having a relatively small activation energy and donor impurity atoms having a relatively large activation energy. Furthermore, the impurities are doped in such a way that the concentration $N_A$ of the acceptor impurity is smaller than the concentration $N_D$ of the donor impurity. Here, a "wide bandgap semiconductor" stands for a semiconductor material having a wider bandgap Eg than silicon (Si) having a bandgap Eg of about 1.1 eV at 300 K, germanium arsenide (GaAs) having a bandgap Eg of about 1.4 eV at 300 K) and the like, which have been studied earlier and have achieved progressive commercialization in the semiconductor industry. For example, typical wide bandgap semiconductors include, at 300 K, zinc telluride (ZnTe) having a bandgap Eg of about 2.2 eV, cadmium sulfide (CdS) having a bandgap Eg of about 2.4 eV, zinc selenide (ZnSe) having a bandgap Eg of about 2.7 eV, gallium nitride (GaN) having a bandgap Eg of about 3.4 eV, zinc sulfide (ZnS) having a bandgap Eg of about 3.7 eV, diamond having a bandgap Eg of about 5.5 eV and aluminium nitride (AlN) having a bandgap Eg of about 5.9 eV. In addition, silicon carbide (SiC) is also an example of a wide bandgap semiconductor. At 300 K, bandgap Eg of about 2.23 eV for 3C—SiC, about 2.93 eV for 6H—SiC, and about 3.26 eV for 4H—SiC have been reported, and a variety of SiC polytypes are usable for the wide bandgap semiconductor layers 1*a*, 1*b*. Various mixed crystals implemented by the combinations of two or three species, or a ternary compound or a quaternary compound of the aforementioned wide bandgap semiconductors are permissible for the wide bandgap semiconductor layers 1*a*, 1*b*. Of these wide bandgap semiconductors and the mixed crystals thereof, in particular, the wide bandgap semiconductor having a bandgap Eg at 300 K of 3.4 eV or more, and the mixed crystals thereof, are preferable for the thermionic emission sources (emitters), because the negative electron affinity of the wide bandgap semiconductor becomes significant as the bandgap Eg increases.

With an illustrative example for diamond, doping can be selected such that the concentration $N_A$ of acceptor impurity atoms is smaller than the concentration $N_D$ of donor impurity atoms—in a concentration of boron (B) as the acceptor impurity ranging from about $10^{15}$ $cm^{-3}$ to about $10^{19}$ $cm^{-3}$ to the corresponding concentration of phosphorus (P) as the donor impurity ranging from about $10^{16}$ $cm^{-3}$ to about $10^{21}$ $cm^{-3}$.

The insulating substrates 7*a*, 7*b*, which are adapted for the supporting members in the discharge electrodes relating to the first embodiment, can be made of quartz glass or ceramic such as alumina ($Al_2O_3$). The fluorescent layer 10 applied to a portion of the inner wall of the discharge envelope 9 emits visible rays, after receiving the radiation of ultraviolet rays, which are generated by discharge in the discharge envelope 9. In addition to the discharge gas 11, the inside of the discharge envelope 9 includes a necessary, given amount of mercury (mercury particle) for establishing the mercury discharge. As discharge gas 11 for aiding lighting, an inert gas such as argon (Ar), neon (Ne), xenon (Xe), or the like can be used; the pressure of the inside of the discharge envelope 9 is set, for example, at from about 5.3 kPa to about 13 kPa. In addition, a percentage of hydrogen gas ($H_2$) is preferably mixed into an inert gas.

As discussed above, in the discharge electrode of the discharge lamp pertaining to the first embodiment, the emitters configured to emit electrons by resistive heating is implemented by the wide bandgap semiconductor layers 1*a*, 1*b*, in which both acceptor impurity atoms having a relatively small activation energy and donor impurity atoms having a relatively large activation energy are doped. FIGS. 2A, 2B, 3A and 3B show the case, in which diamond is used as each of the wide bandgap semiconductor layers 1*a*, 1*b*. In the case of diamond, boron (B) serves as the acceptor impurity atoms 2 having the relatively small activation energy, and phosphorus (P) serves as the donor impurity atoms 4*i*, 4*a* having the relatively large activation energy.

Figure 2A:
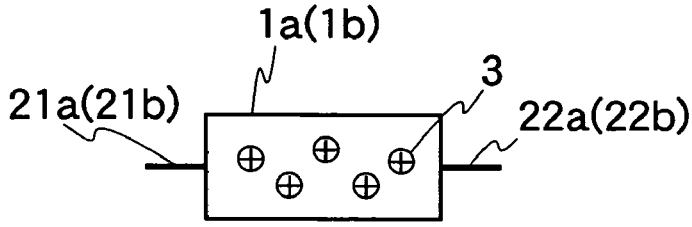
FIGS. 2A and 2B are drawings that describe the conduction state at room temperature of an emitter implemented by a wide bandgap semiconductor layer used in a discharge electrode relating to the first embodiment.
Figure 2B:
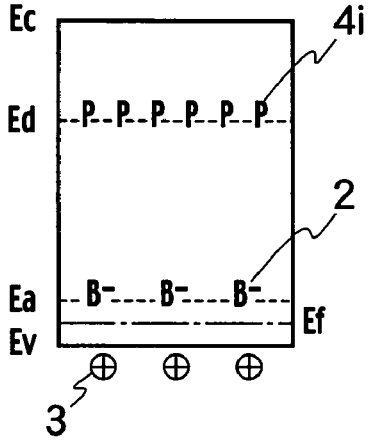

As shown in FIG. 2B, the activation energy (0.2 to 0.3 eV) of the acceptor impurity atoms 2 obtained by subtracting the energy Ev of the valence band edge from the value of the energy level Ea of the acceptor impurity atoms 2 is smaller than that (about 0.5 eV) of the donor impurity atoms 4*i* obtained by subtracting the value of energy level Ed of the donor impurity atoms 41 from the energy Ec of the conduction band edge. At room temperature (300 K), the Fermi level Ef lies between the energy level Ea of the acceptor impurity atoms 2 and the energy Ev of the valence band edge. For this reason, as indicated in FIGS. 2A and 2B, even at room temperature (300 K) electrons at levels close to the valence band edge are trapped in the acceptor impurity atoms 2 to generate holes 3 close to the valence band edge, thereby obtaining p-type conduction. Namely, at the initiation stage of the resistive heating at room temperature, as illustrated in FIG. 2A, p-type conduction is established by holes 3 ascribable to the acceptor impurity atoms 2. At this time, the donor having large activation energy does not provide the conduction band with an electron, and thus the donor impurity atoms 4*i* are in an inactive state. Generation of the holes 3 causes electric current to flow through the wide bandgap semiconductor layers 1*a*, 1*b* themselves, and by turning on electric power, the electric current efficiently heats the wide bandgap semiconductor layers 1*a*, 1*b* themselves.

Figure 3A:
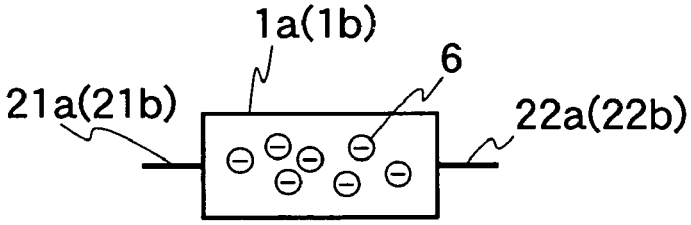
FIGS. 3A and 3B are drawings that describe the conduction state in an elevated temperature state of the emitter implemented by the wide bandgap semiconductor layer used in the discharge electrode relating to the first embodiment.
Figure 3B:
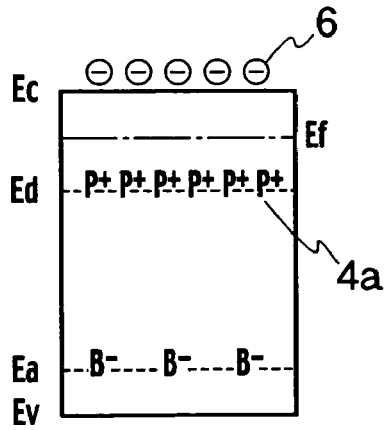

Current flow of the holes 3 heats restively the wide bandgap semiconductor layers 1*a*, 1*b* themselves to about 700K to about 800K; FIG. 3B shows an energy band diagram of the wide bandgap semiconductor layers 1*a*, 1*b* at this elevated temperature. In a state wherein the temperature is increased to a temperature in the range of about 700K to about 800K, the Fermi level Ef lies between the energy Ec of the conduction band edge and the energy level Ed of the donor impurity (activated state) 4*a*.

Namely, the increase of temperature by resistive heating changes the inactive donor impurity atoms 41 to the activated donor impurity atoms 4*a*. In this activated energy state at elevated temperature, electrons being bound to the donor impurity atoms (activated state) 4*a* are supplied to the conduction band so as to establish n-type conduction. In other words, in the wide bandgap semiconductor layers 1*a*, 1*b*, which are heated to a temperature ranging from about 700K to about 800K, sufficient number of electrons 6, required for thermionic emission, are generated as majority carriers.

Figure 4:
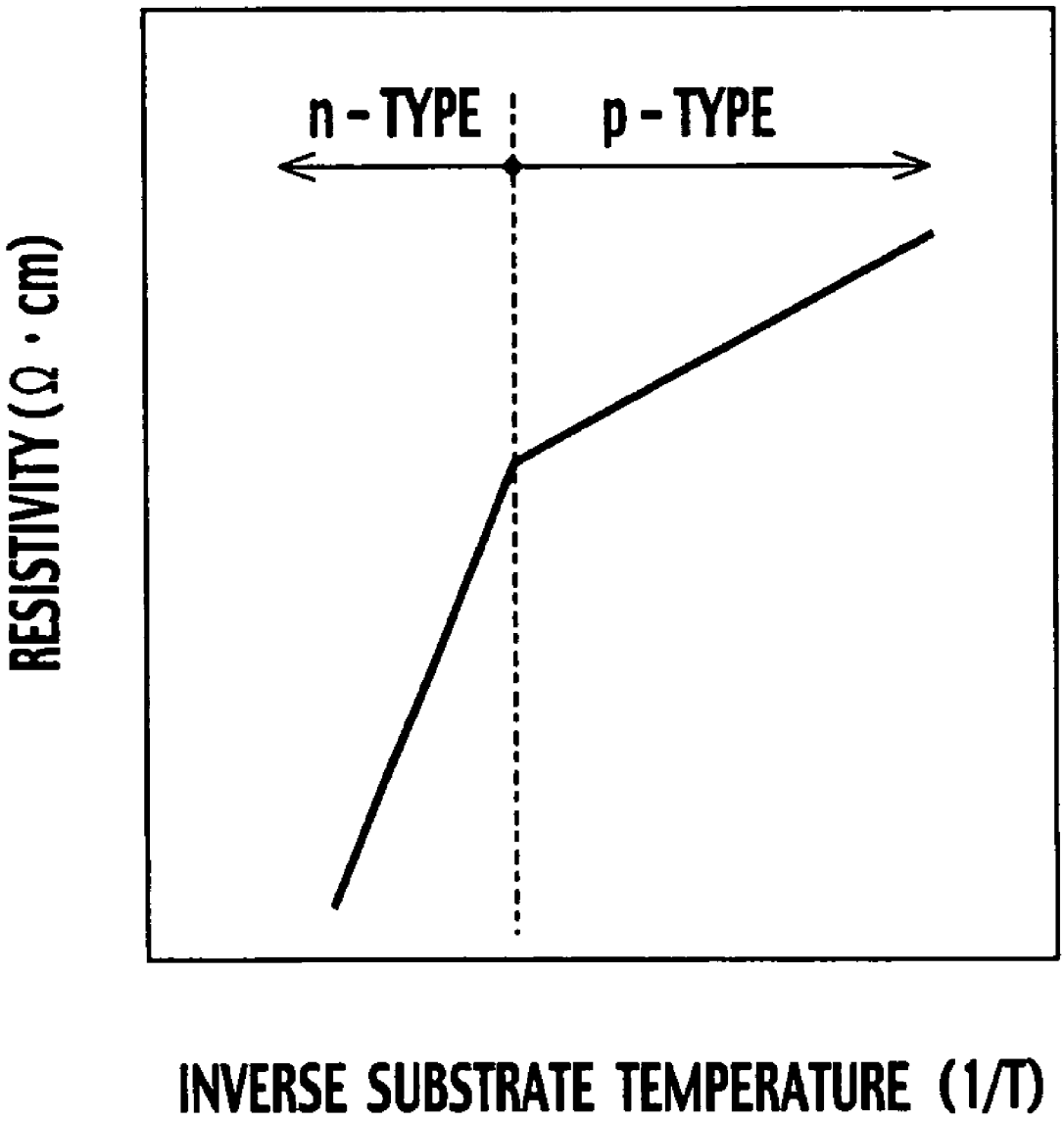
FIG. 4 is a drawing that describes the temperature dependence of the conduction state of an emitter implemented by a wide bandgap semiconductor layer used in a discharge electrode relating to the first embodiment.

FIG. 4 illustrates the temperature dependence of the resistivity of the wide bandgap semiconductor layers 1*a*, 1*b*, which shows that the conduction type changes from p-type conduction regime to n-type conduction regime as the temperature of the wide bandgap semiconductor layers 1*a*, 1*b* is raised. In this manner, according to the first embodiment, because a simple configuration implemented by each of the wide bandgap semiconductor layers 1*a*, 1*b* alone enables a sequence of steps of, from the p-type conduction at the starting point of the heating, the resistive heating by the p-type conduction, the change of conduction types associated with the increase of the temperature, the resistive heating by the n-type conduction and the following thermionic emission by the n-type conduction, the electric power dissipation is minimized in the discharge electrodes. Therefore, the high efficiency and low-temperature hot cathode (thermionic cathode) can be achieved with a simple structure. That is, according to the discharge electrodes pertaining to the first embodiment, the simultaneous donor/acceptor doping effect in the wide bandgap semiconductor layers 1*a*, 1*b* causes electric current to efficiently flow through the wide bandgap semiconductor layers 1*a*, 1*b* from the start of the resistive heating, which efficiently establishes the elevated temperature state, thereby facilitating the electron conduction in the n-type conduction regime suited to the thermionic emission.

In addition, in FIG. 1, while the bottom surfaces of the insulating substrates 7*a*, 7*b* are exposed to discharge gas 11, an architecture is also allowable in which the bottom surfaces of the insulating substrates 7*a*, 7*b* are covered with the wide bandgap semiconductor layers.

Furthermore, the wide bandgap semiconductor layers 1*a*, 1*b* do not necessarily cover all of the top surfaces of the insulating substrates 7*a*, 7*b* uniformly, and may also selectively be formed on portions of the top surfaces of the insulating substrates 7*a*, 7*b* so as to delineate specific wiring patterns, such as a straight stripe shape, a zigzag shape, or a meandering filament.

Figure 5:
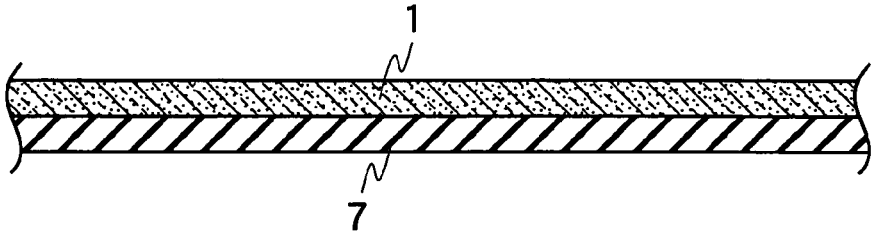
FIG. 5 is a process flow sectional view explaining a manufacturing method of a discharge lamp of the first embodiment.

The discharge electrode pertaining to the first embodiment does not need to attach an extra filament for resistive heating, and therefore the structure is simple; a simple manufacturing process as described below enables mass production, thus being capable of reducing manufacturing costs. With reference to FIGS. 5 to 10, a method for manufacturing a discharge lamp relating to the first embodiment of the present invention will be set forth:

(a) First, a parallel plate slab or a substrate is prepared for a supporting member 7. The supporting member 7 may be an insulating substrate, more specifically, an alumina ($Al_2O_3$) substrate. And, a wide bandgap semiconductor layer 1 is epitaxially grown on the top surface of the supporting member 7 by a chemical vapor deposition (CVD) technique as shown in FIG. 5. The wide bandgap semiconductor layer 1 may be a diamond single crystal layer. Namely, on the $Al_2O_3$ substrate 7, the diamond single crystal layer 1 is epitaxially grown so as to form a composite structure including the supporting member 7 and the wide bandgap semiconductor layer 1 formed on the supporting member 7. The CVD technique can utilize, for example, the plasma CVD process using a high-frequency discharge of 2.45 GHz under a reduced pressure of 4 kPa During the operation, methane ($CH_4$) gas using as a source gas along with hydrogen ($H_2$) gas using as a carrier gas can be supplied at a substrate temperature of 850° C.

When the ratio of the methane ($CH_4$) gas flow rate to the hydrogen ($H_2$) gas flow rate is about 1:99, an epitaxial growth layer 1 of diamond single crystal is obtainable at a growth rate of about 0.5 μm/hr to about 1 μm/hr. During the step, in the wide bandgap semiconductor layer (diamond single crystal layer) 1, boron (B) is doped by using diborane ($B_2H_6$) diluted with $H_2$ gas, and simultaneously, phosphorus (P) is doped by using phosphine ($P_1H$) diluted with $H_2$ gas. Flow rates of the diborane ($B_2H_6$) gas and phosphine ($PH_3$) gas are controlled by mass-flow controllers or the like. Boron (B) serves as an acceptor impurity atom having a relatively small activation energy, and phosphorus (P) serves as a donor impurity atom having a relatively large activation energy in diamond. The wide bandgap semiconductor layer 1 is deposited, for example, to from about 1 to about 100 μm. Arsine ($AsH_3$), hydrogen disulfide ($H_2S$), ammonia ($NH_3$) and the like are usable as an n type dopant gas instead of phosphine.

(b) Next, a titanium-gold (Ti/Au) composite layer or the like is delineated by the lift-off process to form an ion implantation mask. Ar ions ($Ar^+$) are selectively implanted on the top surface of the wide bandgap semiconductor layer 1 using the ion implantation mask at an acceleration energy $E_{ACC}$=40 keV and a dose amount $\phi=10^{16}$ $cm^{-2}$. During the ion implantation, the temperatures of the insulating substrate 7 and the wide bandgap semiconductor layer 1 are kept at room temperature (25° C.). Then, after removal of the ion implantation mask, the resultant material is heat treated at 400° C. to produce an amorphous layer (amorphous contact region). Although a case of $Ar^+$ ion implantation has been described, the ion shall not be limited to $Ar^+$ alone, and a variety of ions are acceptable for the formation of the amorphous layer. For example, element ions of inert gases such as krypton ($Kr^+$), xenon ($Xe^+$) and the like, and carbide-forming element ions such as $Ti^+$, $Ta^+$, $W^+$, $Si^+$, $N^+$, $B^+$, and the like can be used. Of these, if $N^+$ and $B^+$ are implanted to the lattice positions of diamond, these may serve, respectively, as a donor and an acceptor. Rather, it can be considered that implanted $N^+$ and $B^+$ form the carbides (compounds) $NC_{1-x}$ and $BC_{1-x}$ at the top surface of diamond in such a high dose implantation condition of $\phi$ ranging from $10^{15}$ $cm^{-2}$ to $10^{16}$ $cm^{-2}$.

Figure 6:
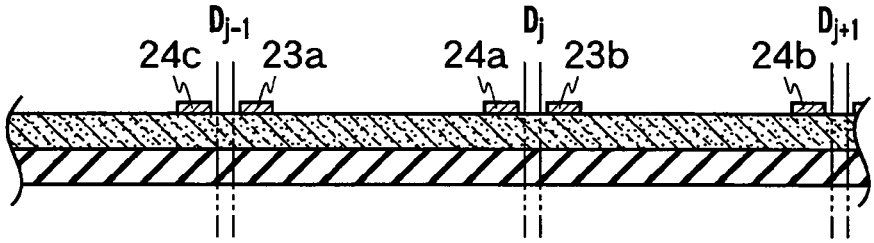
FIG. 6 is a subsequent process flow sectional view explaining the manufacturing method of the discharge lamp of the first embodiment after the process stage shown in FIG. 5.

(c) Then, a mask is aligned on the exact position directly above the amorphous layer (amorphous contact region) so as to establish the lift-off process. Namely, after a successive vacuum evaporation method or a successive sputtering method for continuously depositing a Ti film, a Pt film and an Au film so as to implement Ti/Pt/Au multi-layer film, the Ti/Pt/Au multi-layer film is delineated by the lift-off process to provide respective patterns of the conductive films (contact films) 23*a*, 24*a*; 23*b*, 24*b*, 24*c*, . . . , as shown in FIG. 6. After delineating the conductive films (contact films) 23*a*, 24*a*; 23*b*, 24*b*, 24*c*, . . . , the composite structure (1, 7) is annealed at an elevated temperature of 700° C. to 800° C. so as to achieve a practical contact resistance value ρc for the wide bandgap semiconductor 1.

(d) Next, an oxide film ($SiO_2$ film) with a thickness of 500 nm to 1 μm is deposited on the whole top surface of the wide bandgap semiconductor layer 1 by CVD. Furthermore, a photoresist film is applied to the upper part of the oxide film and is delineated by photolithography. Subsequently, the oxide film is selectively etched using the delineated photoresist film as an etching mask. After patterning the oxide film, the photoresist film is removed. Using the delineated oxide film as an etching mask, the wide bandgap semiconductor layer 1 is selectively etched by reactive ion etching (RIE) using oxygen gas ($O_2$ gas), at spaces between the conductive films (contact films) 24*c* and 23*a*, between the conductive films (contact films) 24*a* and 23*b*, and so on until the insulating substrate 7 is exposed. The space between the conductive films (contact films) 24*c* and 23*a*, the space between the conductive films (contact films) 24*a* and 23*b*, and so on become the dicing lines $D_{j-1}$, $D_j$, $D_{j+1}$, . . . . As a result, along the dicing lines $D_{j-1}$, $D_j$, $D_{j+1}$, . . . , the dicing grooves are formed. When the composite structure (1, 7) is cut along the dicing grooves with diamond blade or the like so as to divide into a plurality of chips, and a plurality of "composite electrode-bodies" each having a desired chip size are cut out.

(e) Next, "a composite electrode-body (7*a*, 1*a*)" is selected from the plurality of "composite electrode-bodies". Furthermore, stem leads 21*a*, 22*a*, portions dose to the centers of which are fixed to a glass ball (bead) 62*a*, are provided. Then, the stem lead 21*a* is contacted at an angular portion of bent portions thereof with the bottom surface of the insulating substrate 7*a* opposing to the conductive film (contact film) 23*a* and pinches "the composite electrode-body (7*a*, 1*a*)" from both the sides by elastic force. Similarly, a stem lead 22*a* is contacted at an angular portion of bent portions thereof with the bottom surface of the insulating substrate 7*a* opposing to the conductive film (contact film) 24*a* and pinches the composite electrode-body (7*a*, 1*a*) from both the sides by elastic force.

Figure 7:
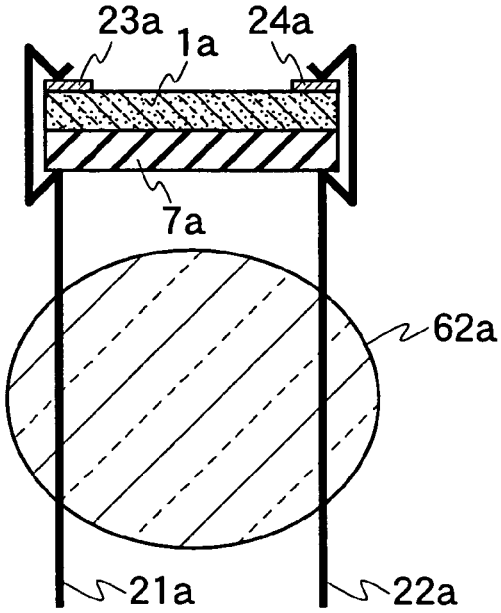
FIG. 7 is a further subsequent process flow sectional view explaining the manufacturing method of the discharge lamp of the first embodiment after the process stage shown in FIG. 6.
Figure 10:
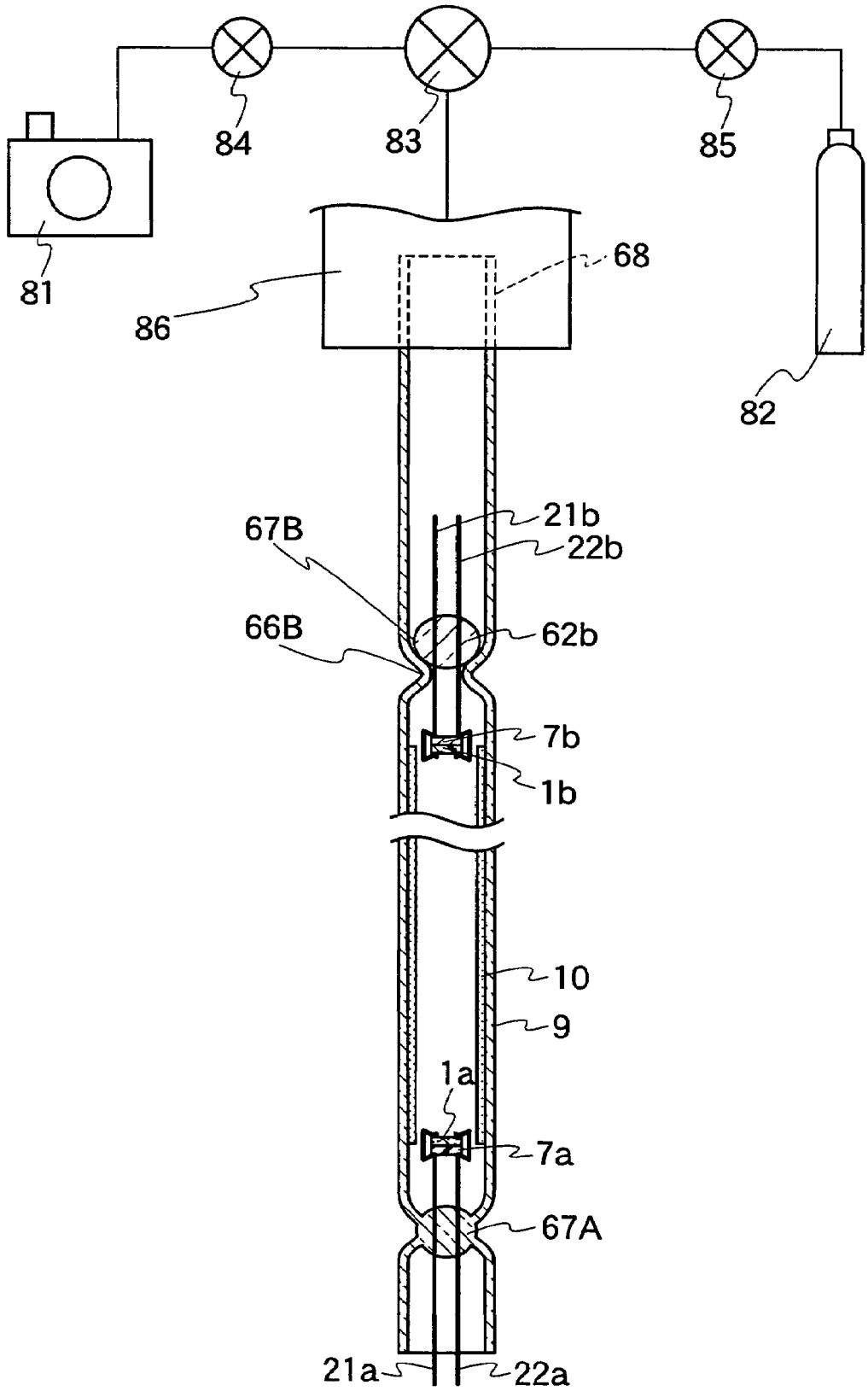
FIG. 10 is a still further subsequent process flow sectional view explaining the manufacturing method of the discharge lamp of the first embodiment after the process stage shown in FIG. 9.

While the illustration is omitted in FIG. 7, another stem leads 21*b*, 22*b*, portions close to the centers of which are fixed to a glass ball (bead) 62*b*, are provided, and, and subsequently the stem lead 22*b* is contacted at an angular portion of bent portions thereof with the bottom surface of the insulating substrate 7*b* opposing to the conductive film (contact film) 24*b* and pinches "a composite electrode-body (7*b*, 1*b*)" from both the sides by elastic force (See FIG. 10). "The composite electrode-body (7*b*, 1*b*)" is also selected from the plurality of "composite electrode-bodies". In this way, a pair of discharge electrodes is produced—one discharge electrode (62*a*, 22*a*, 7*a*, 1*a*, 21*a*, 22*a*) has the glass ball 62*a*, the stem leads 21*a*, 22*a* and the composite electrode-body (7*a*, 1*a*), and the other discharge electrode (62*b*, 22*b*, 7*b*, 1*b*, 21*b*, 22*b*) has the glass ball 62*b*, the stem leads 21*b*, 22*b* and the composite electrode-body (7*b*, 1*b*). Further, in place of the glass balls 62*a*, 62*b*, a glass stem in a trumpet shape or the like may be used.

Figure 8:
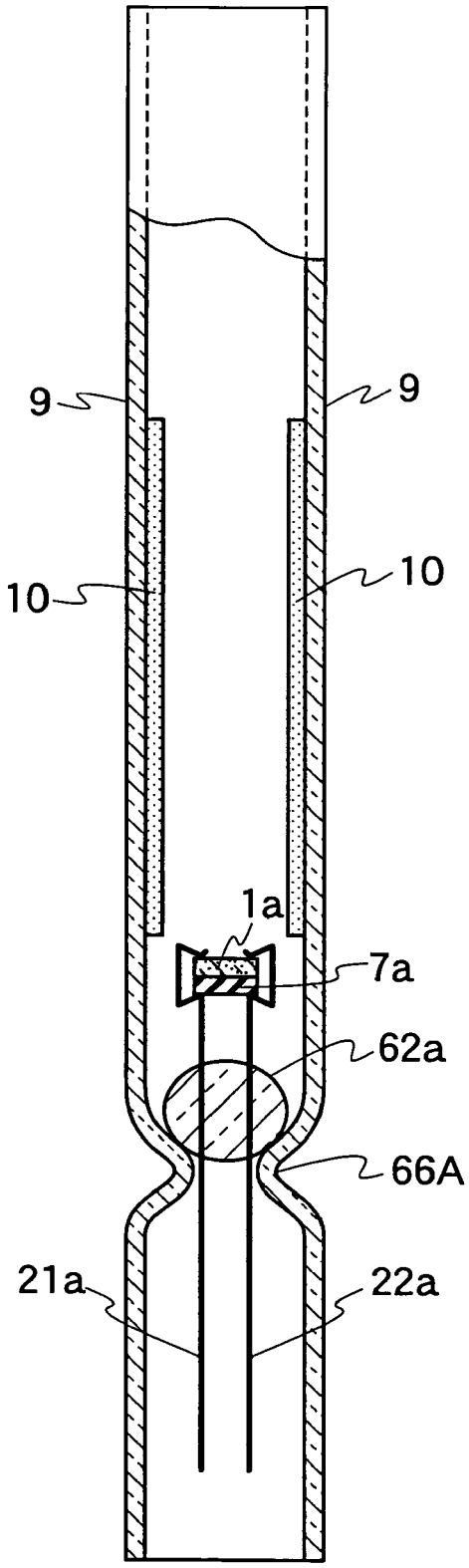
FIG. 8 is a still further subsequent process flow sectional view explaining the manufacturing method of the discharge lamp of the first embodiment after the process stage shown in FIG. 7.
Figure 9:
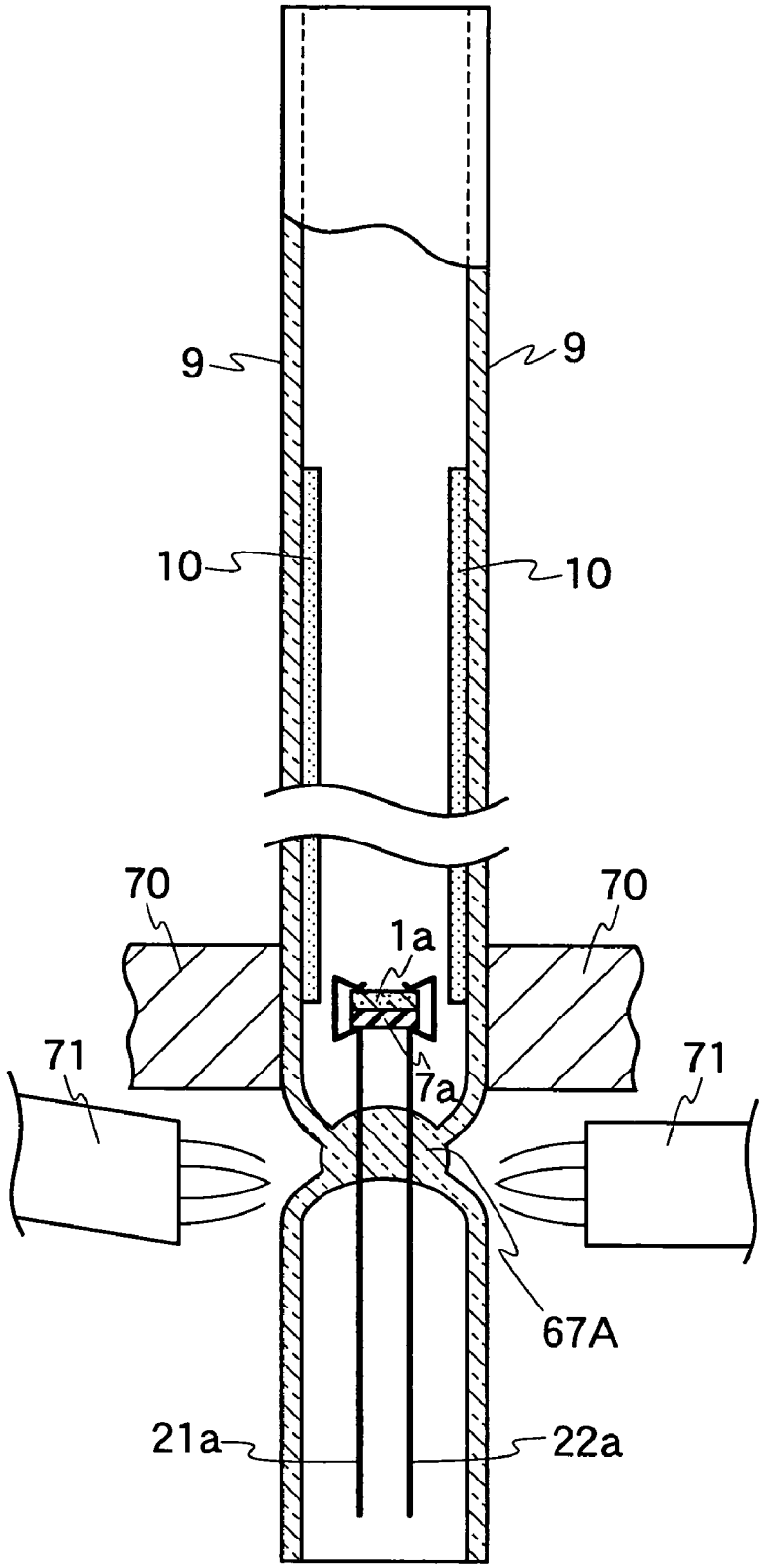
FIG. 9 is a still further subsequent process flow sectional view explaining the manufacturing method of the discharge lamp of the first embodiment after the process stage shown in FIG. 8.

(f) Next, as illustrated in FIG. 8, a cylindrical glass tube (discharge envelope) 9, to a partial region of which a fluorescent layer 10 is applied, is provided. A narrow portion 66A is formed in a lower portion of the glass tube 9. Electing the discharge electrode (62*a*, 22*a*, 7*a*, 1*a*, 21*a*, 22*a*) having the glass ball 62*a*, the stem leads 21*a*, 22*a* and the composite electrode-body (7*a*, 1*a*) as one of a pair of discharge electrodes, the glass ball 62*a* is mounted on a shoulder of the narrow portion 66A so that the stem leads 21*a*, 22*a* and the composite electrode-body (7*a*, 1*a*) can be set at a specified position within the glass tube 9 as shown in FIG. 8. After fixing securely the glass tube 9, by supporting an upper neighboring portion of the narrow portion 66A with a supporting stage 70 as indicated in FIG. 9, vicinities of the narrow portion 66A and the glass ball 62*a* are heated using a burner or the like to melt the glass tube 9 and the glass ball 62*a* and weld both, thereby forming a sealed portion 67A for sealing an end of the glass tube 9. Then, as illustrated in FIG. 10, electing the discharge electrode (62*b*, 22*b*, 7*b*, 1*b*, 21*b*, 22*b*) having the glass ball 62*b*, the stem leads 21*b*, 22*b* and the composite electrode-body (7*b*, 1*b*) as another one of the pair of discharge electrodes, the glass ball 62*b* is mounted on a shoulder of the narrow portion 66B so that the stem leads 21*b*, 22*b* and the composite electrode-body (7*b*, 1*b*) can be set at a specified position within the glass tube 9 as shown in FIG. 8. And subsequently, an open end portion 68 of the narrow portion 66B side of the glass tube 9 is connected to the pumping head 86 of pumping equipment. The pumping equipment has a vacuum pump 81, which is configured to aspirate air in the glass tube 9 so as to evacuate the inside of the glass tube 9, and a gas supply source 82, which is configured to introduce the discharge gas 11 such as argon into the glass tube 9. The pumping equipment further encompasses a transfer valve 83, which is configured to transfer mutually the evacuation process by vacuum pump 81 and the discharge gas introduction process by the gas supply source 82. Furthermore, the pumping equipment embraces an exhaust magnet valve 84 and an intake magnet valve 85. The transfer valve 83 is connected to the pumping head 86.

(g) Then, the vacuum pump 81 is operated to evacuate air within the glass tube 9 for achieving a specific ultimate pressure, by opening the vacuum exhaust passage via the exhaust magnet valve 84 and the transfer valve 83, with the glass tube 9, equipped with the pair of discharge electrodes, being connected to the pumping head 86. Thereafter, a small amount of mercury is sealed in the glass tube 9 together with a specified discharge gas 11 such as argon from the gas supply source 82 through the transfer valve 83 and the intake magnet valve 85. Further, subsequently, the proximity of the narrow portion 66B and the glass ball 62*b* is heated with a gas burner or the like to melt the glass tube 9 and the glass ball 62*b* and weld both, thus forming the other sealed portion 67B of the discharge lamp. Subsequently, removal of the unnecessary portions outside the sealed portions of the glass tube provides the discharge lamp shown in FIG. 1.

According to the method for manufacturing a discharge lamp pertaining to the first embodiment of the present invention, because of no need for attaching an extra filament for resistive heating, dicing the wide bandgap semiconductor layer 1 collectively formed on a large insulating substrate 7 along the dicing lines $D_{j-1}$, $D_j$, $D_{j+1}$, . . . and pinching by elastic force both the ends thereof with the stem leads 21*a*, 22*a* or the stem leads 21*b*, 22*b* alone enables the manufacturing of a discharge electrode, thereby permitting mass production and reduction of manufacturing costs.

In addition, the method for manufacturing the discharge lamp described above is an example, and other different manufacturing methods are of course possible, including modifications thereof. For example, in the above-described embodiment, although the wide bandgap semiconductor layer 1 is blanketly grown on the large insulating substrate 7 and a plurality of resulting bodies are divided along dicing lines $D_{j-1}$, $D_j$, $D_{j+1}$, . . . ; a plurality of chips, or chip-likely divided insulating substrates 7*a*, 7*b* . . . are provided firstly, and wide bandgap semiconductor layers 1*a*, 1*b*, . . . may individually be formed on the chip-likely divided insulating substrates 7*a*, 7*b*.

Second Embodiment

Figure 11:
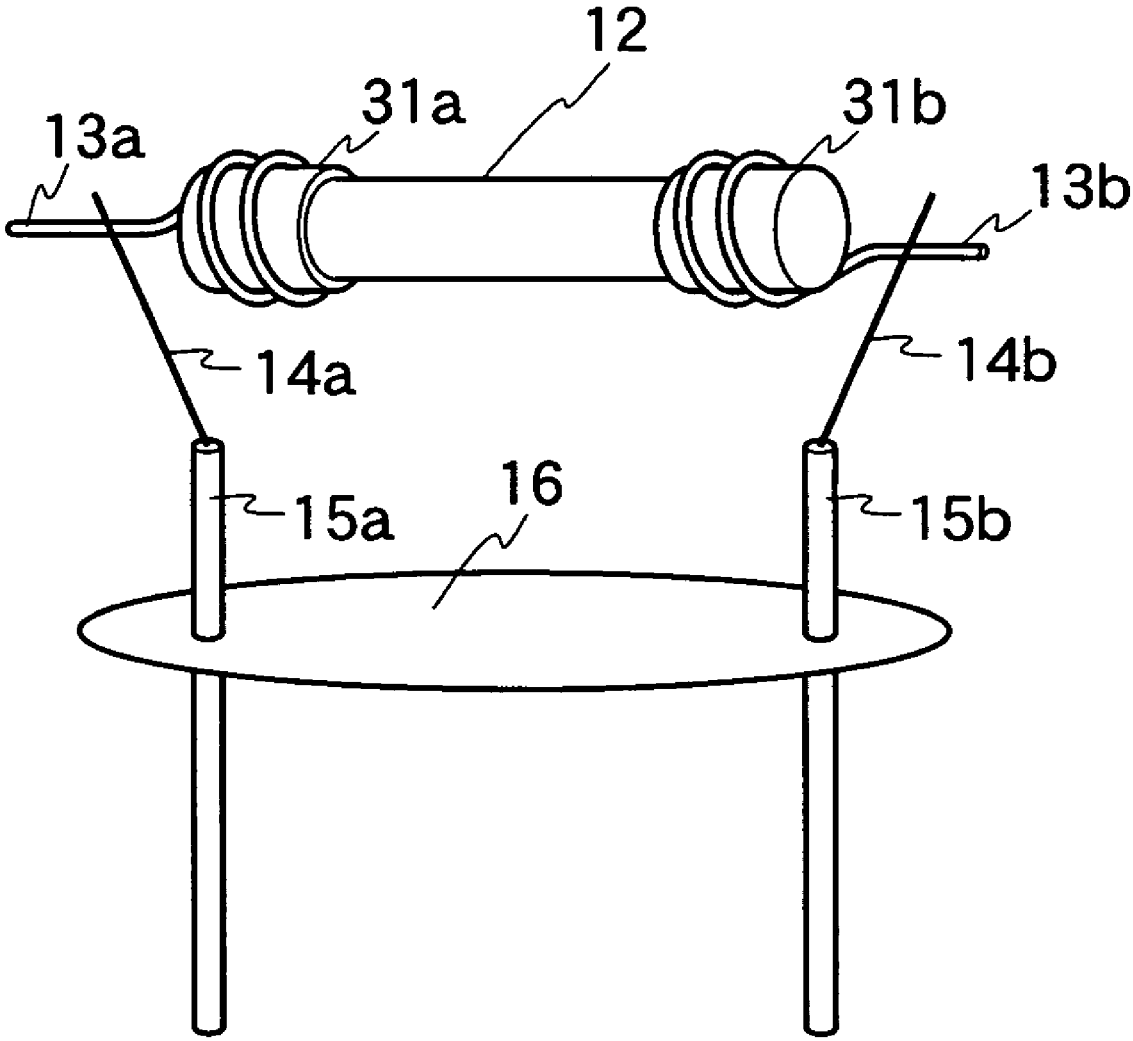
FIG. 11 is a schematic cross sectional view showing an overview of a discharge electrode relating to a second embodiment of the present invention.

As shown in FIG. 11, a discharge electrode of a discharge lamp relating to a second embodiment of the present invention encompasses a wide bandgap semiconductor rod 12 serving as an emitter, conductive films (contact films) 31*a*, 31*b* selectively formed at outer peripheries of vicinities of both the ends of the wide bandgap semiconductor rod 12, a lead wire 13*a* wound around the left side end of the wide bandgap semiconductor rod 12 through the conductive film (contact film) 31*a*, and a lead wire 13*b* wound around the right-hand side end of the wide bandgap semiconductor rod 12 through the conductive film (contact film) 31*b*.

The wide bandgap semiconductor rod 12 is a pillar-shaped rod, which can establish a prism shape having an edge of 50 μm to 300 μm, or a cylindrical shape having a diameter of 50 μm to 300 μm. The prism shape does not necessarily have a square in cross section; the cross-sectional shape may be a rectangle, or a pentagon or a polygon having more angles than a pentagon. Lead wires 13*a*, 13*b* can utilize, for example, a lead-in wire configuration such as "Dumet wire" encompassing a core wire made of iron-nickel (Fe—Ni) alloy, or the like and a coating with copper (Cu) film on the core wire.

Although illustration is omitted, on a surface of the wide bandgap semiconductor rod 12 directly below the conductive films (contact films) 31*a*, 31*b*, amorphous layers (amorphous contact regions) are formed, respectively. As such, the conductive films 31*a*, 31*b* each make a low-contact-resistance ohmic contact to the outer peripheries close to both ends of the wide bandgap semiconductor rod 12. Materials for the conductive films 31*a*, 31*b* can be selected from the group including Ni, W, Ti, Cr, Ta, Mo, Au, and the like. Further, the combinations of materials listed in the group can be employed as the conductive films 31*a*, 31*b*. For example, multi-layer film s such as Ti/Pt/Au and Ti/Ni/Pt/Au as well as Ti/Ni/Pt/Au and the like, which were discussed in the discharge lamp relating to the first embodiment can be employed as the conductive films 31*a*, 31*b* in the second embodiment. However, in a specific application field that permits relatively high contact resistance of an electrode may omit, as necessary, the conductive films 31*a*, 31*b*, and/or the amorphous layers (amorphous contact regions).

Then, the lead wire 13*a* electrically connected to the left end of the wide bandgap semiconductor rod 12 is supported by a suspension wire 14*a*; the lead wire 13*b* electrically connected to the right-hand end of the wide bandgap semiconductor rod 12 is supported by a suspension wire 14*b*. Further, the suspension wires 14*a*, 14*b* each are welded to stem pins 15*a*, 15*b* fixed to a stem 16, which fixes the wide bandgap semiconductor rod 12 to the stem 16 to implement a discharge electrode. Here, the lead wire 13*a*, the suspension wire 14*a* and the stem pin 15*a* serve as one of the pair of current supply terminals for supplying electric current to the emitter made of the wide bandgap semiconductor rod 12; the lead wire 13*b*, the suspension wire 14*b* and the stem pin 15*b* function as another of the pair of current supply terminals for supplying electric current to the emitter made of the wide bandgap semiconductor rod 12.

As in the case of the discharge electrode of the discharge lamp pertaining to the first embodiment, both acceptor impurity atoms having a comparatively small activation energy and donor impurity atoms having a comparatively large activation energy are doped to the wide bandgap semiconductor rod 12 in such a way that the concentration $N_A$ of the acceptor impurity atoms is smaller than the concentration $N_D$ of the donor impurity atoms.

Figure 12:
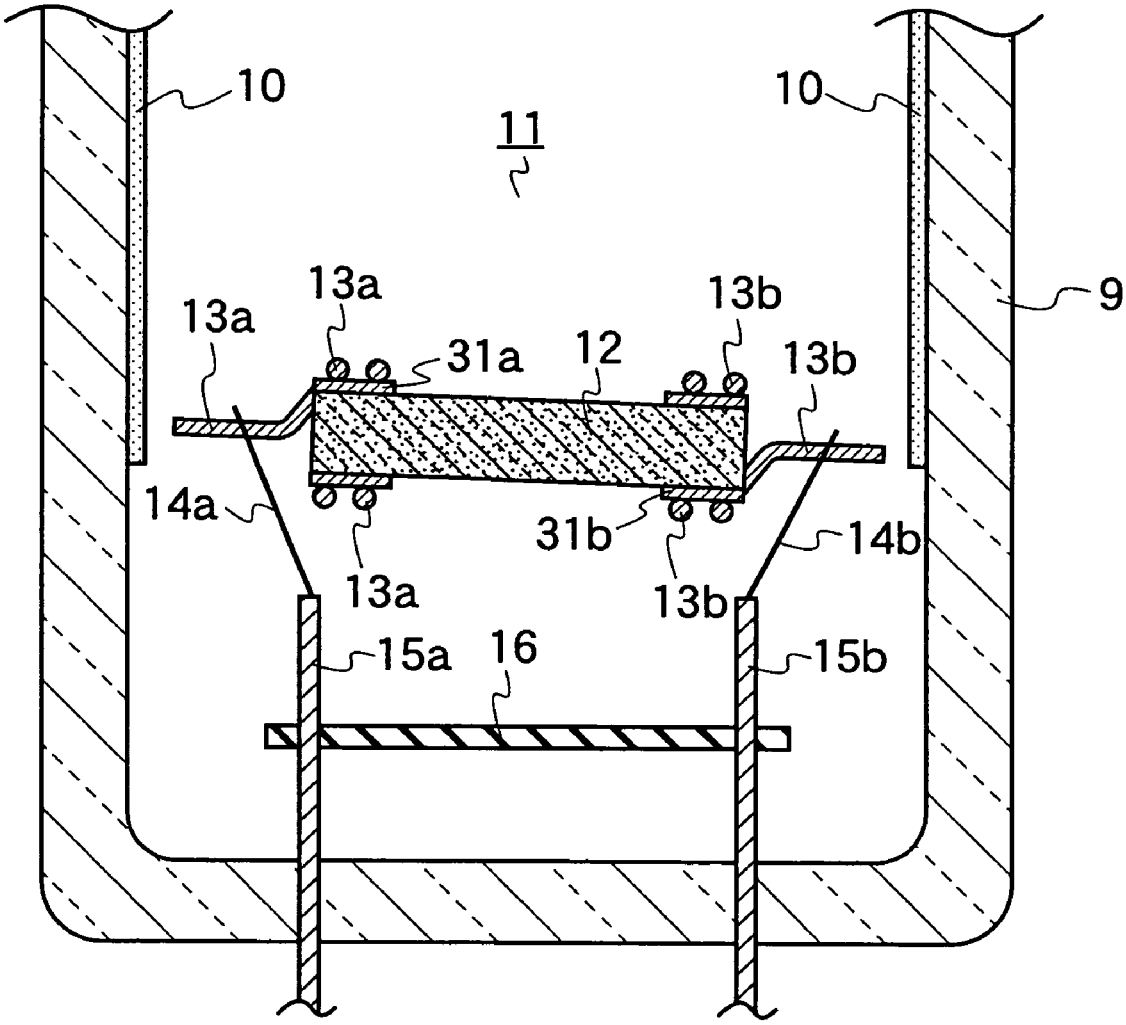
FIG. 12 is a schematic cross sectional view showing an overview of a discharge lamp relating to the second embodiment.

In the second embodiment, the discharge lamp shown in FIG. 11 is installed in a discharge envelope 9 as shown in FIG. 12. In the discharge envelope 9, a discharge gas 11 is sealed and a fluorescent layer 10 is applied to a portion of the inner wall of the discharge envelope 9. Of course, a pair of discharge electrodes is disposed at both ends of the discharge envelope 9. However, in FIG. 12, the illustration of the opposing discharge electrode is omitted As in the case of the discharge lamp of the first embodiment, in addition to the discharge gas 11, a necessary, given amount of mercury (mercury particle) for establishing the mercury discharge is sealed in the discharge envelope 9.

In the discharge electrode of the discharge lamp pertaining to the second embodiment, the wide bandgap semiconductor rod 12 itself serves as a resistive heating material, and therefore the lead wires 13*a*, 13*b* can be wound around both ends only, and do not need to be wound around the whole surface of the wide bandgap semiconductor rod 12.

Third Embodiment

Figure 13:
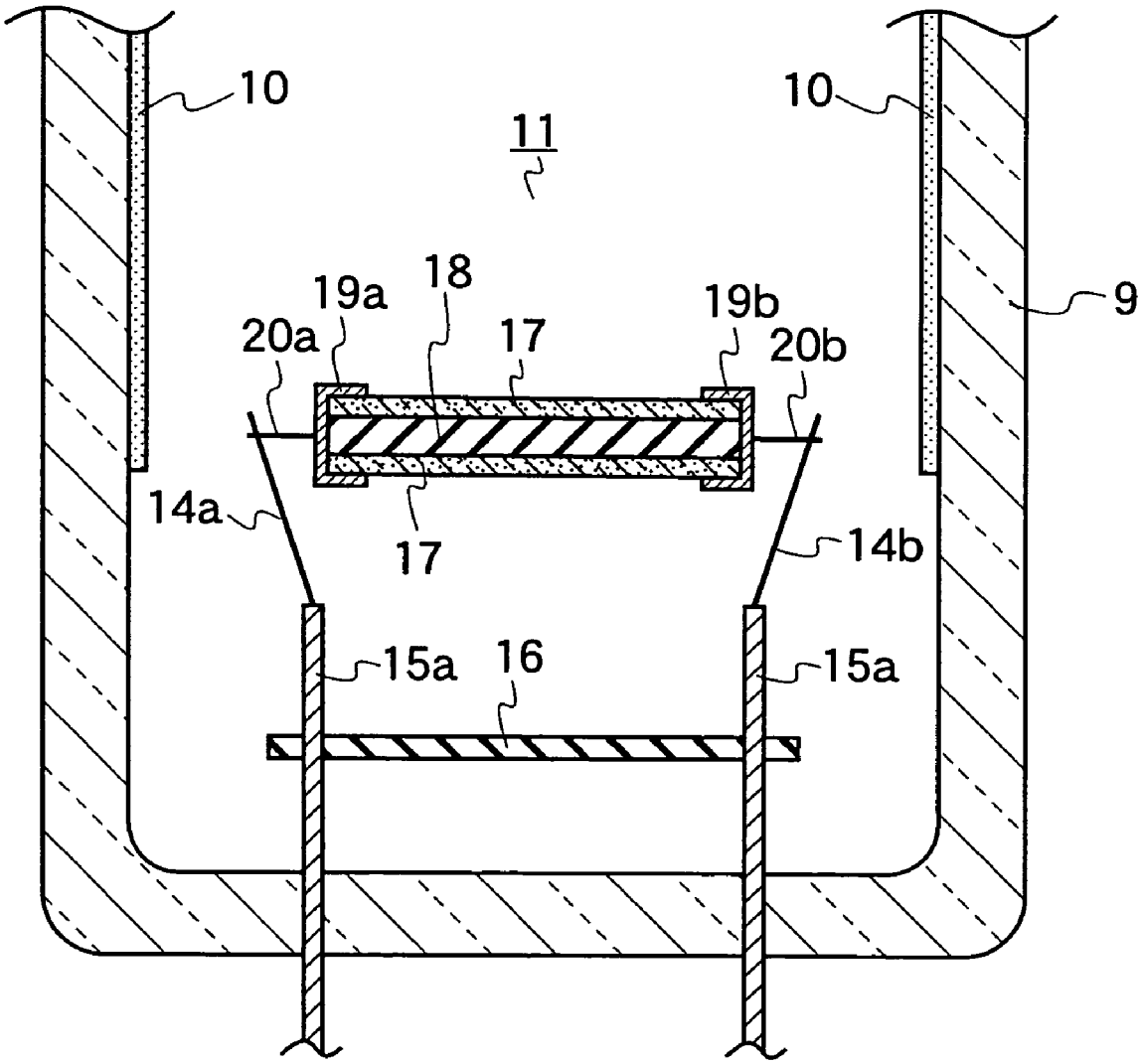
FIG. 13 is a schematic cross sectional view showing an overview of a discharge lamp relating to a third embodiment of the present invention.

As indicated in FIG. 13, a discharge electrode of a discharge lamp relating to a third embodiment of the present invention encompasses a cylindrical insulating core member 18 serving as a supporting member and a wide bandgap semiconductor layer 17 coating on the entire outer surface of the insulating core member 18, serving as an emitter, both implementing a cylindrical composite electrode-body (17, 18). Instead of the cylindrical insulating core member 18, a prism-shaped insulating core member 18 can be used as the supporting member, and in this case, a prism-shaped composite electrode-body (17, 18) will be established instead of the cylindrical composite electrode-body (17, 18).

The discharge electrode encompasses cap-shaped conductive films (electrode layers) 19*a*, 19*b* selectively formed at the outer peripheries of both edges of the wide bandgap semiconductor layer (emitter) 17, an electrode pin 20*a* welded at the conductive film (electrode layer) 19*a*, and an electrode pin 20*b* welded at the conductive film (electrode layer) 19*b*. While the illustration is omitted, amorphous layers (amorphous contact regions) are formed in proximate regions of the outer peripheral surfaces at both edges of the wide bandgap semiconductor layer 17 directly beneath the inner wall of each of cap-shaped conductive films 19*a*, 19*b*.

Hence, the conductive films 19*a*, 19*b* each form a low-contact-resistance ohmic contact to the outer peripheries of both end vicinities of the wide bandgap semiconductor layer 17. The conductive films 19*a*, 19*b* can utilize any one of Ni, W, Ti, Cr, Ta, Mo, Au, and the like and any combination of these metals. The combination of these metals can include multi-layer film s such as Ti/Pt/Au and Ti/Ni/Pt/Au as well as Ti/Ni/Pt/Au and the like, which were discussed in the discharge lamps relating to the first and the second embodiments.

The electrode pin 20*a* connected to the left end of the cylindrical (or prism-shaped) composite electrode-body (17, 18) through the conductive films 19*a*, 19*b* is supported by a suspension wire 14*a*; the electrode pin 20*b* connected to the right-hand end of the composite electrode-body (17, 18) is supported by a suspension wire 14*b*. Further, the suspension wires 14*a*, 14*b* each are welded to stem pins 15*a*, 15*b* fixed to a stem 16, which fixes the composite electrode-body (17, 18) to the stem 16. The combination of these elements (17, 18, 19*a*, 19*b*, 20*a*, 20*b*, 14*a*, 14*b*, 15*a*, 15*b*, 16) implements the discharge electrode of the third embodiment.

Here, the conductive film (electrode layer) 19*a*, the electrode pin 20*a*, the suspension wire 14*a* and the stem pin 15*a* function as one of the pair of current supply terminals for supplying electric current to the emitter made of the wide bandgap semiconductor layer 17; the conductive film (electrode layer) 19*b*, the electrode pin 20*b*, the suspension wire 14*b* and the stem pin 15*b* function as another of the pair of current supply terminals for supplying electric current to the emitter made of the wide bandgap semiconductor layer 17.

As in the case of discharge electrodes of discharge lamps concerning the first and the second embodiments, both acceptor impurity atoms having a comparatively small activation energy and donor impurity atoms having a comparatively large activation energy are doped to the wide bandgap semiconductor layer 17 so that the concentration $N_A$ of the acceptor impurity atoms is smaller than the concentration $N_D$ of the donor impurity atoms.

As shown in FIG. 13, the discharge lamp pertaining to the third embodiment is the same as the discharge lamps relating to the first and second embodiments in that the discharge lamp encompasses the discharge envelope 9 in which the discharge gas 11 is sealed, the fluorescent layer 10 partly applied to the inner wall of the discharge envelope 9 and a pair of discharge electrodes placed at both ends of the discharge envelope 9. However, FIG. 13 omits illustration of the other opposing discharge electrode. The feature that, at a necessary, a given amount of mercury (mercury particle) is additionally sealed inside the discharge envelope 9 to the discharge gas 11 is the same as the discharge lamps relating to the first and second embodiments.

The discharge electrode of the third embodiment can readily be fabricated by means of a CVD process, or the like that involves depositing the wide bandgap semiconductor layer 17 on the insulating core member 18 and then dividing the resulting material, as appropriate, into the required length. As a matter of course, a plurality of insulating core member 18 may first be provided, each of the insulating core members 18 having the required length for use, and subsequently the wide bandgap semiconductor layer 17 can be coated on the respective insulating core members 18 by a CVD process, or the like as well.

Other Embodiments

Various modifications will become possible for those skilled in the art after receiving the teaching of the present disclosure without departing from the scope thereof.

The first to the third embodiments described thus far have primarily discussed hot cathodes. However, electron emissions from the discharge electrodes shall not be limited to pure thermionic emissions, but may involve effects caused by electric fields.

Thus, the present invention of course includes various embodiments and modifications and the like which are not detailed above. Therefore, the scope of the present invention will be defined in the following claims.

What is claimed is:

1. A discharge electrode emitting electrons by thermionic emission into a discharge gas, comprising:

an emitter comprising a wide bandgap semiconductor having at 300 K a bandgap of 2.2 eV or wider, the wide bandgap semiconductor including a region in which both acceptor impurity atoms and donor impurity atoms are doped, an activation energy of the donor impurity atoms, which is obtained by subtracting a value of an energy level of the donor impurity atoms from an energy level of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter for resistively heating the emitter so as to establish the thermionic emission.

2. The discharge electrode of claim 1, wherein the wide bandgap semiconductor has at 300 K the bandgap of 3.4 eV or wider.

3. The discharge electrode of claim 1, wherein the emitter is provided on an insulating supporting member.

4. The discharge electrode of claim 1, wherein the emitter is provided on a surface of an insulating substrate.

5. The discharge electrode of claim 1, wherein the emitter covers an outer surface of an insulating core member.

6. The discharge electrode of claim 1, wherein the emitter is a pillar-shaped rod.

7. The discharge electrode of claim 1, further comprising a conductive film disposed selectively on a surface of the emitter, one of the current supply terminals electrically connecting to the emitter via the conductive film.

8. The discharge electrode of claim 1, further comprising an amorphous layer of the wide bandgap semiconductor formed selectively at the surface of the emitter, wherein one of the current supply terminals electrically connects to the emitter through the amorphous layer.

9. A discharge electrode emitting electrons into a discharge gas, comprising:

an emitter comprising a wide bandgap semiconductor having at 300 K a bandgap of 2.2 eV or wider, acceptor impurity atoms and donor impurity atoms being doped in the wide bandgap semiconductor, an activation energy of the donor impurity atoms, which is obtained by subtracting a value of an energy level of the donor impurity atoms from an energy level of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter, wherein the concentration of the donor impurity atoms is higher than that of the acceptor impurity atoms.

10. A discharge lamp comprising:

a discharge envelope in which a discharge gas is sealed; and a discharge electrode configured to emit electrons by thermionic emission, disposed in the discharge envelope, comprising:

an emitter comprising a wide bandgap semiconductor having at 300 K a bandgap of 2.2 eV or wider, the wide bandgap semiconductor including a region in which both acceptor impurity atoms and donor impurity atoms are doped, an activation energy of the donor impurity atoms, which is obtained by subtracting a value of an energy level of the donor impurity atoms from an energy of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter for resistively heating the emitter so as to establish the thermionic emission.

11. The discharge lamp of claim 10, wherein the wide bandgap semiconductor has at 300 K the bandgap of 3.4 eV or wider.

12. The discharge lamp of claim 10, wherein the emitter is provided on an insulating supporting member.

13. The discharge lamp of claim 10, wherein the emitter is provided on a surface of an insulating substrate.

14. The discharge lamp of claim 10, wherein the emitter covers an outer surface of an insulating core member.

15. The discharge lamp of claim 10, wherein the emitter is a pillar-shaped rod.

16. The discharge lamp of claim 10, further comprising a conductive film disposed selectively on a surface of the emitter, one of the current supply terminals electrically connecting to the emitter via the conductive film.

17. The discharge lamp of claim 10, further comprising an amorphous layer of the wide bandgap semiconductor formed selectively at the surface of the emitter, wherein one of the current supply terminals electrically connects to the emitter through the amorphous layer.

18. A discharge lamp comprising:

a discharge envelope in which a discharge gas is sealed; and a discharge electrode disposed in the discharge envelope, comprising:

an emitter comprising a wide bandgap semiconductor having at 300 K a bandgap of 2.2 eV or wider, acceptor impurity atoms and donor impurity atoms being doped in the wide bandgap semiconductor, an activation energy of the donor impurity atoms, which is obtained by subtracting a value of an energy level of the donor impurity atoms from an energy of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter, wherein the concentration of the donor impurity atoms is higher than that of the acceptor impurity atoms.

19. A discharge electrode of emitting electrons into a discharge gas, comprising:

an emitter comprising a wide bandgap semiconductor having at 300 K a bandgap of 2.2 eV or wider, acceptor impurity atoms and donor impurity atoms being doped in the wide bandgap semiconductor, an activation energy of the donor impurity atoms, which is obtained by subtracting a value of an energy level of the donor impurity atoms from an energy level of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter, wherein the concentration of the donor impurity atoms ranges from about $10^{16}$ $cm^{-3}$ to about $10^{21}$ $cm^{-3}$ and the concentration of the acceptor impurity atoms ranges from about $10^{15}$ $cm^{-3}$ to about $10^{19}$ $cm^{-3}$.

20. A discharge electrode emitting electrons into a discharge gas, comprising:

an emitter comprising a wide bandgap semiconductor having at 300 K a bandgap of 2.2 eV or wider, acceptor impurity atoms and donor impurity atoms being doped in the wide bandgap semiconductor, an activation energy of the donor impurity atoms, which is obtained by subtracting a value of an energy level of the donor impurity atoms from an energy level of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter, wherein conductivity type of the wide bandgap semiconductor changes from p-type to n-type conduction with an increase of temperature.

21. A discharge lamp comprising:

a discharge envelope in which a discharge gas is sealed; and a discharge electrode disposed in the discharge envelope, comprising:

an emitter comprising a wide bandgap semiconductor having at 300 K a bandgap of 2.2 eV or wider, acceptor impurity atoms and donor impurity atoms being doped in the wide bandgap semiconductor, an activation energy of the donor impurity atoms, which is obtained by subtracting a value of an energy level of the donor impurity atoms from an energy of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter, wherein the concentration of the donor impurity atoms ranges from about $10^{16}$ $cm^{-3}$ to about $10^{21}$ $cm^{-3}$ and the concentration of the acceptor impurity atoms ranges from about $10^{15}$ $cm^{-3}$ to about $10^{19}$ $cm^{-3}$.

22. A discharge lamp comprising:

a discharge envelope in which a discharge gas is sealed; and a discharge electrode disposed in the discharge envelope, comprising:

an emitter comprising a wide bandgap semiconductor having at 300 K a bandgap of 2.2 eV or wider, acceptor impurity atoms and donor impurity atoms being doped in the wide bandgap semiconductor, an activation energy of the donor impurity atoms, which is obtained by subtracting a value of an energy level of the donor impurity atoms from an energy of conduction band edge, being larger than the activation energy of the acceptor impurity atoms, which is obtained by subtracting an energy of a valence band edge from a value of an energy level of the acceptor impurity atoms; and current supply terminals configured to supply electric current to the emitter, wherein conductivity type of the wide bandgap semiconductor changes from p-type to n-type conduction with an increase of temperature.

* * * * *